US008601724B2

(12) United States Patent
Shiue et al.

(10) Patent No.: US 8,601,724 B2
(45) Date of Patent: Dec. 10, 2013

(54) GOLF SHOES

(76) Inventors: Po-Hai Shiue, Kaohsiung (TW);
Po-Hsiang Hsueh, Kaohsiung (TW)

( * ) Notice: Subject to any disclaimer, the term of this patent is extended or adjusted under 35 U.S.C. 154(b) by 395 days.

(21) Appl. No.: 12/953,704

(22) Filed: Nov. 24, 2010

(65) Prior Publication Data

US 2012/0005924 A1 Jan. 12, 2012

(30) Foreign Application Priority Data

Jul. 8, 2010 (TW) ..... 99122516 A

(51) Int. Cl.
*A43B 5/00* (2006.01)

(52) U.S. Cl.
USPC ..... 36/127; 36/134

(58) Field of Classification Search
USPC ..... 36/127, 134, 61, 62
See application file for complete search history.

(56) References Cited

U.S. PATENT DOCUMENTS

| | | | | | |
|---|---|---|---|---|---|
| 4,937,954 | A * | 7/1990 | Clement | 36/127 |
| 5,692,318 | A * | 12/1997 | Aliano, Jr. | 36/25 R |
| 5,926,980 | A * | 7/1999 | Adam | 36/134 |
| 5,960,568 | A * | 10/1999 | Bell et al. | 36/134 |
| 6,006,454 | A * | 12/1999 | Sitzler, Sr. | 36/127 |
| 6,253,468 | B1 * | 7/2001 | Hirota | 36/134 |
| 6,502,332 | B1 * | 1/2003 | Nakayama | 36/134 |
| 6,694,647 | B1 * | 2/2004 | Patterson et al. | 36/127 |
| 7,076,894 | B2 * | 7/2006 | Santos et al. | 36/134 |
| 2010/0257751 | A1 * | 10/2010 | Burt et al. | 36/66 |

* cited by examiner

*Primary Examiner* — Jila M Mohandesi
(74) *Attorney, Agent, or Firm* — Rosenberg, Klein & Lee

(57) ABSTRACT

Golf shoes are revealed. The golf shoes include auxiliary supports arranged at the positions which golf players' center of gravity shifted to during the strike. Thus the center of gravity of the player changed during the swing is supported by the auxiliary supports for maintaining the lower body of the player stable throughout the lift. The power of the strike is maintained due to the firm lower body. The accuracy is also good, not affected by changes of the center of gravity of the body. Therefore the player can swing through easily and have a nice shoot smoothly.

3 Claims, 9 Drawing Sheets

GOLF SHOES

BACKGROUND OF THE INVENTION

1. Field of the Invention

The present invention relates to golf shoes, especially to a pair of golf shoes that support the center gravity of players shifted during the swing and keep the players' bodies stable. Thus both power and accuracy of the strike are maintained. Therefore, the player can have a good swing.

2. Description of Related Art

Refer to FIG. 7, FIG. 8 and FIG. 9, schematic drawings showing the assembly between golf spikes and shoe soles of golf shoes available now are revealed. A receptacle 8 is connected with a shoe sole 7 and a threaded round hole 81 is set on the receptacle 8. The threaded round hole 81 is corresponding to and threaded with a round threaded rod 91 arranged above golf spikes 9. However, after being worn for a period of time, the golf spikes 9 available now is easy to slip off. This causes inconvenience in use.

For right-handed players, the body weight is distributed evenly on both soles of the feet in the beginning of the swing. While taking a back swing, the body weight moves at the direction a club moves so that the center of gravity gradually moves onto the right side of the soles of the feet. When the club is swung up to reach the top point, the center of gravity is stacked over the right side of the soles of the feet completely. While taking a downswing, the player turns the upper body in opposite direction, and the body gravity is gradually shifted to the left side of the soles of the feet. After finishing the swing, the weight is evenly distributed on both soles of the feet again. On the other hand, for left-handed players, the center of gravity is shifted to the right side of the soles of the feet.

During the swing, the player is easy to lose balance. Especially when the back swing starts, the center of gravity is totally shifted to one side of the soles of the feet. Thus that side of the sole of the foot is pressed by the body weight and is projecting from the limited area supported by the shoe sole. Thus the grip force at that side of the sole of the foot is significantly reduced. This leads to instability of the lower limbs of the player and the body position is moved. Thus the shot losses power and the accuracy of the downswing is affected. Therefore, it's difficult for the player to hit the bail and reach the optimal position.

SUMMARY OF THE INVENTION

Therefore it is a primary object of the present invention to provide golf shoes that support golf players whose center of gravity changes throughout golf swings so as to help them maintain balance. Thus the golf player can have a smooth and stable swing.

In order to achieve above object, golf shoes of the present invention include auxiliary supports arranged at the positions that the player's weight shifted to during the strike. Thus the shifted center of gravity of the player is supported by the auxiliary supports and the lower body of the player is stabilized throughout the lift. The center of gravity of the body has not swayed. The force of the swing and the energy transferred to the ball are maintained due to the firm base of the lower body. Without common faults, the accuracy is dramatically improved. Therefore the player can make a good shot easily and smoothly.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
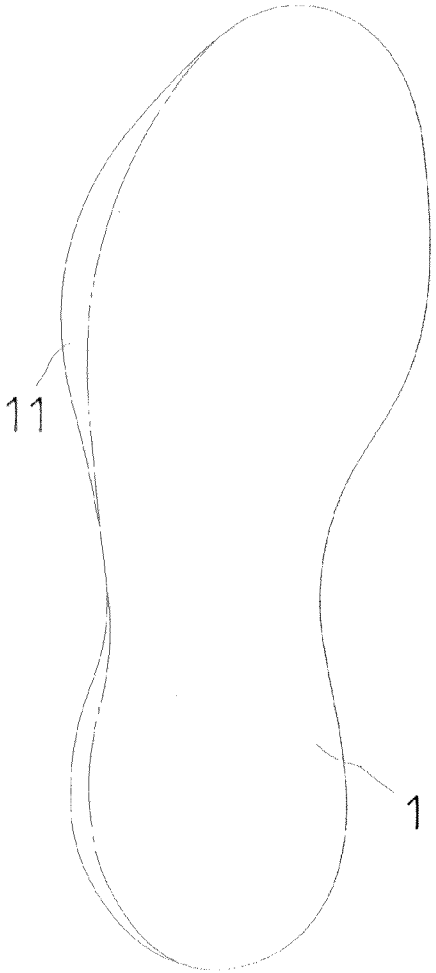
FIG. 1 is a schematic drawing showing a left sole and a right sole of golf shoes for left-handed players according to the present invention.

As shown in FIG. 1, golf shoes of the present invention are designed according to the movement of player's body weight while making a swing. Thus an auxiliary support extends out of an edge on the same side of both a left sole and a right sole of golf shoes.

Figure 2:
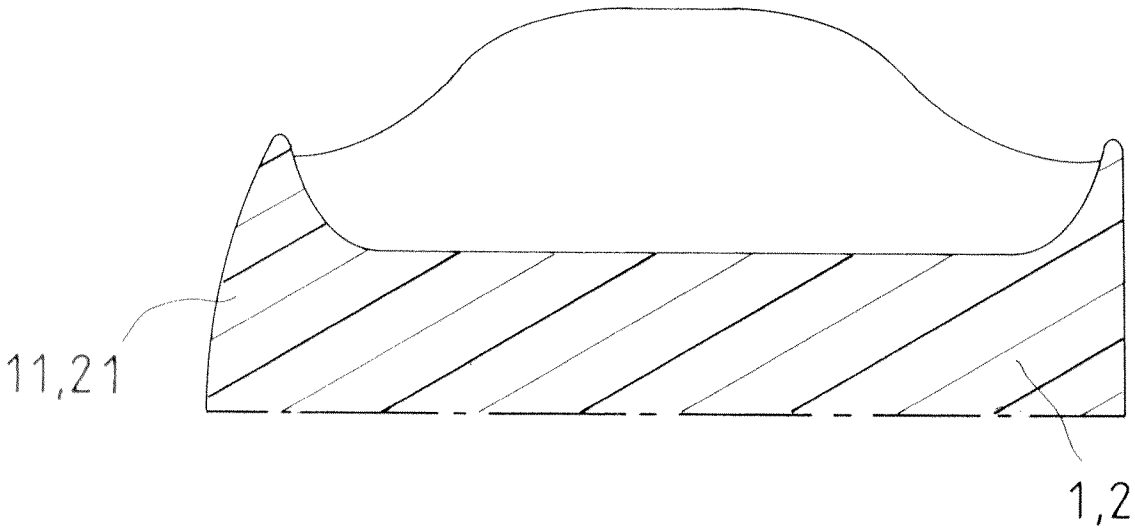
FIG. 2 is a cross sectional view of the left sole and the right sole of golf shoes for left-handed players according to the present invention.

Refer to FIG. 1 and FIG. 2, golf shoes for left-handed players are revealed. An auxiliary support 11 extends out of an edge on the left side of a left shoe sole 1 of golf shoes and an edge on the left side of a right shoe sole 2 of golf shoes is also arranged with an auxiliary support 21.

Figure 3:
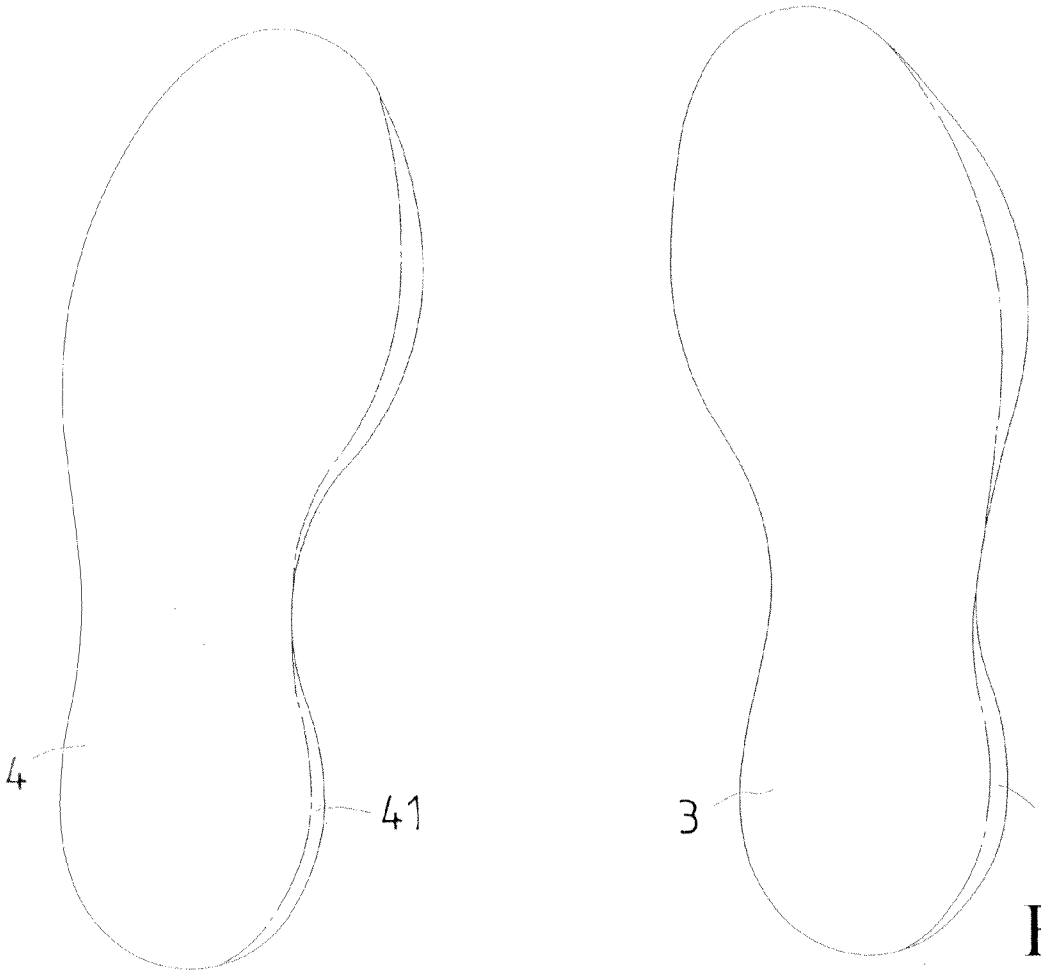
FIG. 3 is a schematic drawing showing a left sole and a right sole of golf shoes for right-handed players according to the present invention.
Figure 4:
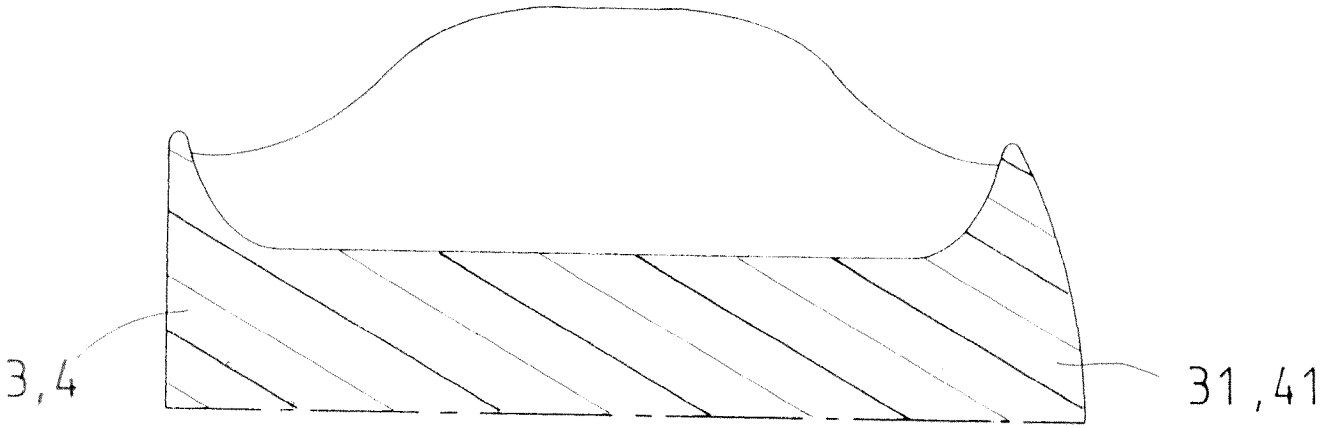
FIG. 4 is a cross sectional view of the left sole and the right sole of golf shoes for right-handed players according to the present invention.

Refer to FIG. 3 and FIG. 4, as to golf shoes for right-handed players, an auxiliary support 31 extends from an edge on the right side of a right shoe sole 3 of golf shoes while an auxiliary support 41 extends from an edge on the right side of a left shoe sole 4.

Referring back to FIG. 1 and FIG. 2, when a left-handed player takes a swing with golf shoes of the present invention, he shifts his body weight from both feet at start-up to the lift side of each sole of the feet along with the twist of the body to the left. The center of gravity of the body moves to the left side of the soles of the feet totally when the swing reaches the top. Now by means of the auxiliary support 11 on the left side of the left shoe sole 1 and the auxiliary support 21 on the left side of the right shoe sole 2 of the golf shoes, the center of gravity shifted to the left side of the soles of the feet gets good support in the strike. Thus the center of gravity of the body is maintained steadily. The left-handed player keeps good balance and takes a downswing to strike the ball.

On the other hand, refer to FIG. 3 and FIG. 4, for right-handed players, they wear golf shoes having the auxiliary support 31 extending on the right side of the right shoe sole 3 and the auxiliary support 41 on the right side of the left shoe sole 4. Thus for the right-handed players, the body weight is gradually shifted to the right side of the soles of the feet. As shown in FIG. 3, by means of the auxiliary support 31 on the right side of the right shoe sole and the auxiliary support 41 on the right side of the left shoe sole 4 of the golf shoes, the gravity of the right-handed player shifted to the right side of the body gets support, the lower limbs of the player are more stable and the position of the player is not moved during the swing. Moreover, during the following rotation process in the downswing, the soles of the feet of the player step on the shoe soles stably without resistance, the swing is completely smoothly, and the ball is struck well.

Figure 5:
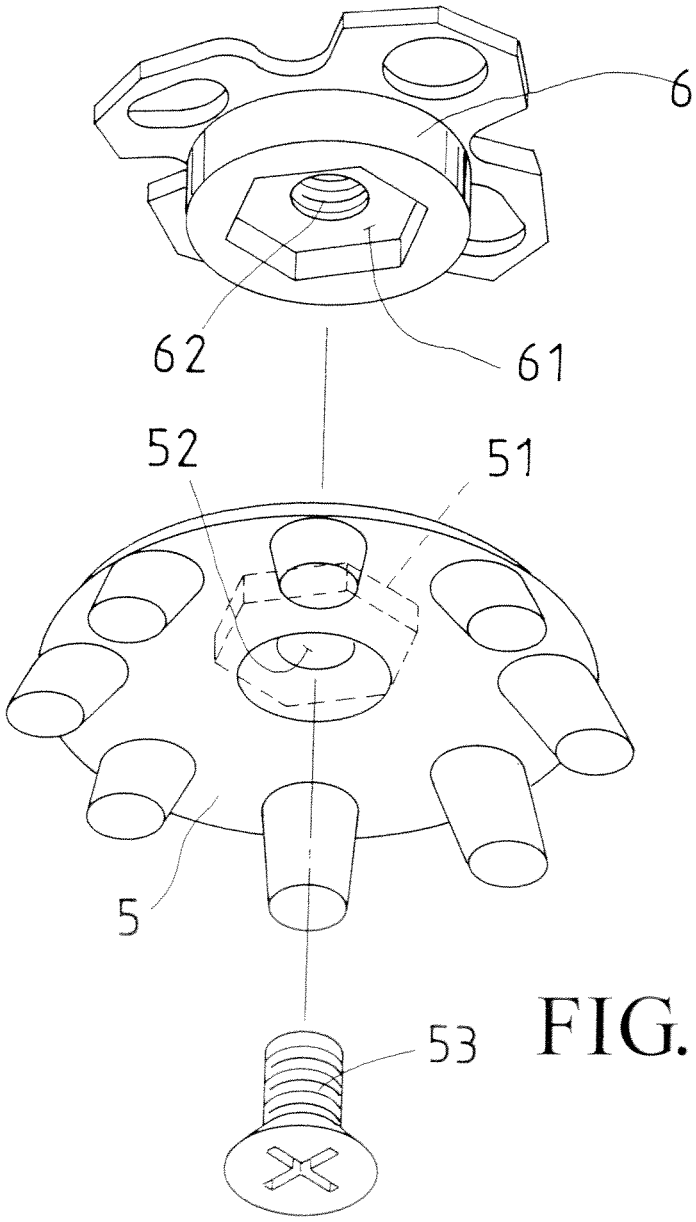
FIG. 5 is an explosive view of golf shoe spikes and a receptacle of an embodiment according to the present invention.
Figure 6:
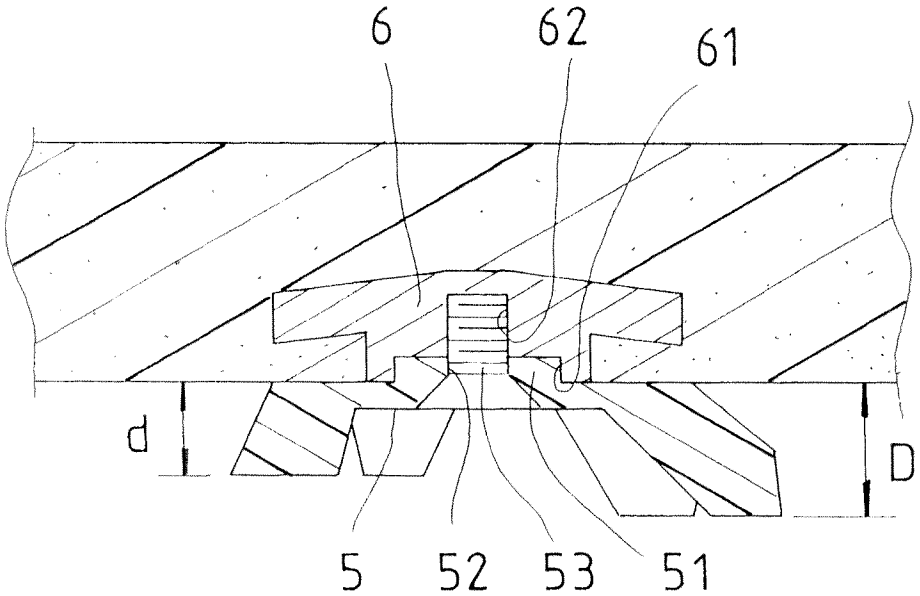
FIG. 6 is a cross sectional of an assembly having golf shoe spikes and a receptacle of an embodiment according to the present invention.
Figure 7:
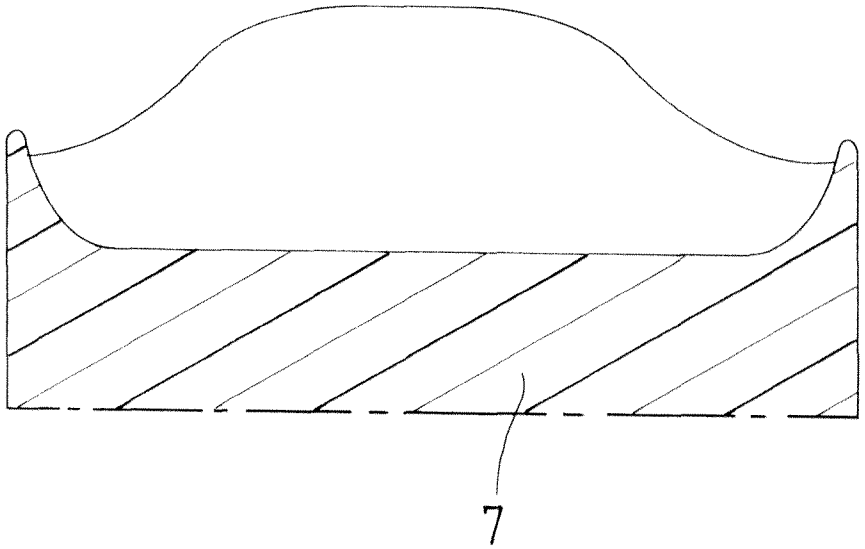
FIG. 7 (PRIOR ART)
FIG. 7 is a cross sectional view of a golf shoe sole available now.
Figure 8:
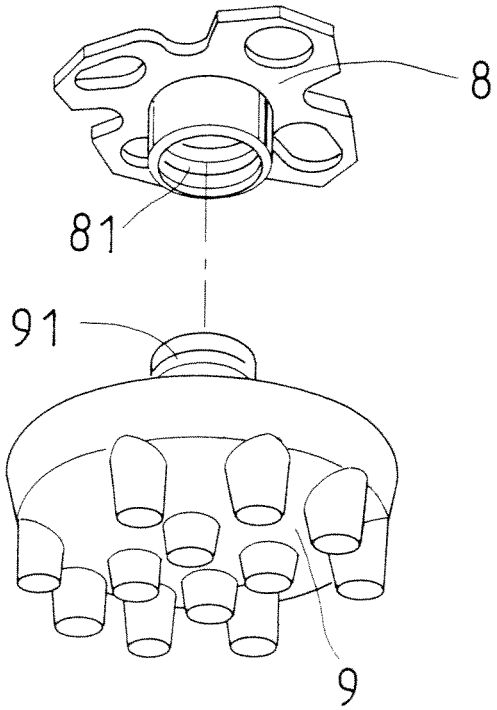
FIG.8 (PRIOR ART)
FIG. 8 is an explosive view of golf shoe spikes and a receptacle of golf shoes available now.
Figure 9:
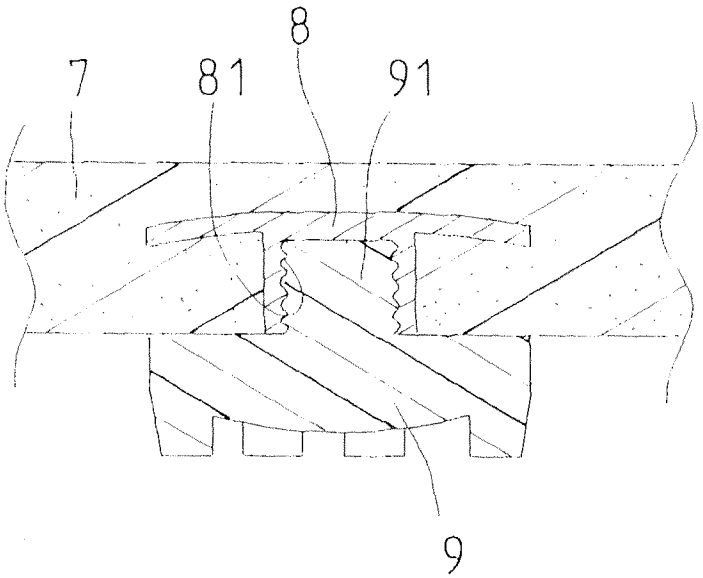
FIG.9 (PRIOR ART)
FIG. 9 is a cross sectional of an assembly having golf shoe spikes and a receptacle of golf shoes available now.

Furthermore, in order to improve the stability during the swing process, refer to FIG. 5 and FIG. 6, the length D of projections on one side of golf shoe spikes 5 is larger than the length d of projection on the other side of the golf shoe spikes 5. Thereby while assembling golf shoes for left-handed players, one side of the golf shoe spikes 5 having projections with larger length D is set near the left side of the left shoe sole 1 while the other side of the golf shoe spikes 5 having projections with shorter length d is set around the right side. The golf shoe spikes 5 are assembled on the right shoe sole 2 in the similar way. Thus while the left-handed player making a swing and the body weight shifting to the left side, the projections with larger length D on one side of the golf shoe spikes 5 are pushed into the ground. This helps the golf player grip the around firmly and keeps the lower body (the foundation) steady so as to make a good swing.

On the other hand, for right-handed players, one side of the golf shoe spikes 5 having projections with larger length D is set near the right side of the right shoe sole 3 while the other side of the golf shoe spikes 5 having projections with shorter length d is set near the left side. The golf shoe spikes 5 are assembled on the left shoe sole 4 in the similar way. Thereby while taking a swing, the gravity of the right-handed player is shifted to the right side and the projections with larger length D on one side of the golf shoe spikes 5 are placed into the ground so as to make the player grip the around more tightly by the golf shoes.

Refer to FIG. 5 and FIG. 6, in order to prevent the golf shoe spikes 5 from rotating and loosening due to torque in the swing or walking, a receptacle 6 connected to the shoe soles of the golf shoes includes a polygonal socket 61 and a threaded hole 62 arranged at the center of the socket 61. One end of the golf shoe spikes 5 facing the socket 61 is disposed with a polygonal assembly block 51 so as to connect and assemble with the socket 61 of the receptacle b. A through hole 52 corresponding to the threaded hole 62 of the receptacle 6 is set on the center of the golf shoe spikes 5. A common screw 53 passes through the through hole 52 of the golf shoe spikes 5 to be threaded and fastened with the threaded hole 62 of the receptacle 6. Thus the assembly block 51 of the golf shoe spikes 5 and the socket 61 of the receptacle 6 against each other keep the golf shoe spikes 5 from rotating and loosening in the swing or during the walking. Moreover, the screw 53 is a screw with general specification and is available on the market now. Thus while removing the golf shoe spikes 5, users only need a common screw driver for loosening and tightening the screw 53. This enhances the convenience in use.

In accordance with the structure and the embodiments mentioned above, the present invention has following advantages:

1. According to the shift of the body gravity of golf players, each shoe sole of the golf shoes is arranged with an auxiliary support extending out of an edge of the position that the body gravity shifts to during the swing. Thereby the shifted body gravity of the player is supported by the auxiliary support and the foundation of the player is steady. Thus the player can keep balance and the body positioned is not moved. Moreover, both the striking force accumulated during the back swing process and the accuracy of downswing are maintained. Therefore, the player can make a perfect swing with increasing strength and accuracy.
2. The receptacle on the shoe sole of the golf shoes includes the polygonal socket while the polygonal assembly block corresponding to the socket of the receptacle is disposed on one end of the golf shoe spikes facing the socket. Thus the rotating and loosening of the golf shoe spikes caused by the torque during the swing or walking can be avoided by the assembly block of the golf shoe spikes and the socket of the receptacle connected and against each other.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. Golf shoes comprising:

an auxiliary support extending from and disposed along a left edge of both of a left shoe sole and a right shoe sole;

a receptacle connected to each of the left shoe sole and the right shoe sole, the receptacle including a polygonal socket with a threaded hole centrally located therethrough;

a plurality of spikes, one end of each spike being connected to an underside of a polygonal assembly block and another end engaging with a ground surface, the spikes being orientated around a centrally located hole in the assembly block with the spikes disposed adjacent to the auxiliary support being longer than non-adjacent spikes; and a screw passing through the assembly block and engaging with the threaded hole in the receptacle to permit connection of the assembly block to the receptacle.

2. Golf shoes comprising:

an auxiliary support extending from and disposed along a right edge of both of a left shoe sole and a right shoe sole;

a receptacle connected to each of the left shoe sole and the right shoe sole, the receptacle including a polygonal socket with a threaded hole centrally located therethrough;

a plurality of spikes, one end of each spike being connected to an underside of a polygonal assembly block and another end engaging with a ground surface, the spikes being orientated around a centrally located hole in the assembly block with the spikes disposed adjacent to the auxiliary support being longer than non-adjacent spikes; and a screw passing through the assembly block and engaging with the threaded hole in the receptacle to permit connection of the assembly block to the receptacle.

3. Golf shoes comprising:

a left shoe sole and a right shoe sole, each of the left shoe sole and the right shoe sole having an auxiliary support extending from and disposed along one side thereof, the one side of each of the left and right shoe soles being a side corresponding to a user's dominant hand;

a receptacle connected to each of the left shoe sole and the right shoe sole, the receptacle having a threaded hole formed therein;

a plurality of spikes extending from a first side of a base, the base having a centrally located hole; and a screw passing through the central hole in the base and engaging with the threaded hole in the receptacle for coupling therewith;

wherein the receptacle includes a polygonal socket with the threaded hole being centrally located therethrough, and the base includes a polygonal assembly block extending from a central portion of a second side thereof for mating engagement within polygonal socket of the receptacle, a portion of the plurality of spikes being longer than a remaining portion thereof, the longer spikes being positioned adjacent to the auxiliary support.

* * * * *